United States Patent [19]

Hsieh

[11] Patent Number: 4,616,694

[45] Date of Patent: Oct. 14, 1986

[54] FIREPROOF CABINET SYSTEM FOR ELECTRONIC EQUIPMENT

[76] Inventor: Shih-yung Hsieh, Apt. 4G, 41-70 Union St., Flushing, N.Y. 11355

[21] Appl. No.: 663,344

[22] Filed: Oct. 22, 1984

[51] Int. Cl.[4] ..... A62C 37/18; F28D 5/02; B67D 1/08

[52] U.S. Cl. ..... 165/47; 62/316; 169/48; 169/61; 220/88 B; 222/53; 222/152; 361/384; 361/385

[58] Field of Search ..... 165/47; 220/88 R, 88 B; 222/53, 54, 152; 169/45, 48, 54, 56, 60, 61; 62/314, 316; 361/384, 385

[56] References Cited

U.S. PATENT DOCUMENTS

| | | | |
|---|---|---|---|
| 1,347,057 | 7/1920 | Ross | 220/88 B |
| 2,311,374 | 2/1943 | Farmer et al. | 169/61 |
| 2,341,437 | 2/1944 | Getz | 169/61 X |
| 2,901,893 | 9/1959 | Saltzman | 62/316 X |
| 2,906,103 | 9/1959 | Saltzman | 62/314 X |
| 3,403,733 | 10/1968 | Terry | 169/56 X |
| 3,732,930 | 5/1973 | D'Anneo | 169/56 |
| 3,750,161 | 7/1973 | Teeters | 169/61 |
| 3,754,600 | 8/1973 | Miller | 169/45 |
| 3,866,687 | 2/1975 | Banner | 169/61 |
| 4,063,595 | 12/1977 | Phillips | 169/60 |

FOREIGN PATENT DOCUMENTS

| | | | |
|---|---|---|---|
| 2617946 | 10/1977 | Fed. Rep. of Germany | 169/56 |
| 524826 | 9/1921 | France | 222/152 |
| 0034339 | 3/1977 | Japan | 169/60 |
| 2078512A | 1/1982 | United Kingdom | 169/61 |

*Primary Examiner*—Sheldon J. Richter
*Assistant Examiner*—Randolph A. Smith
*Attorney, Agent, or Firm*—Philip Young

[57] ABSTRACT

A fireproof cabinet system for electronic equipment including a wall shield with an outer metal layer that acts as a radiation shield, an inner support layer and an insulation layer. A water supply nozzle is mounted on top of the fireproof cabinet system for providing a continuous stream of cooling water on the cabinet shield for minimizing fire damage of the shield and also providing a temperature barrier for the electronic equipment. A forced air cooling system provides cool air from a supply located outside of the equipment room to the cabinet where the coolant air is ducted along the top and side walls of the cabinet in a sheath formed between the cabinet wall and the interior so that the coolant air in combination with the cooling water act to cool both the equipment and to remove heat caused by the external fire. By providing an independent coolant air supply from outside the fire area leading directly into ducts in the cabinet, combined with the coolant water being applied continuously to the external wall shield, the operational condition of the equipment is maintained during the course of the external fire.

17 Claims, 8 Drawing Figures

FIG. 2.1
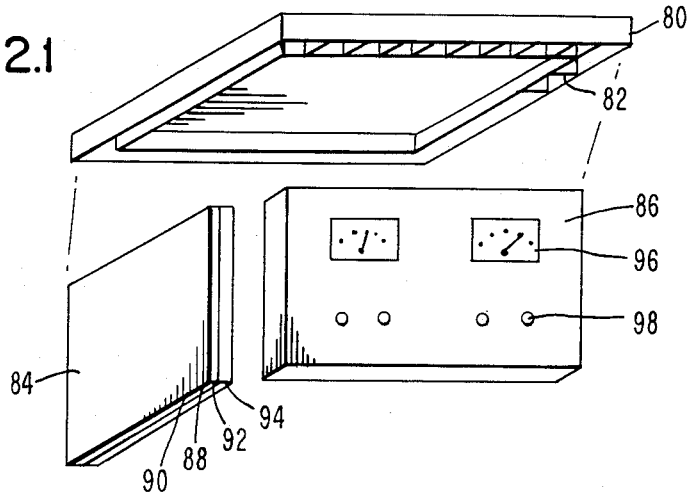
FIG. 2.2
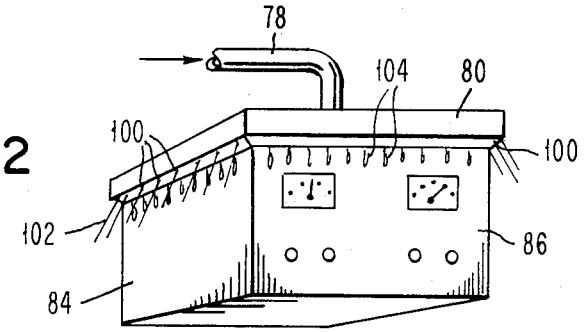
FIG. 6
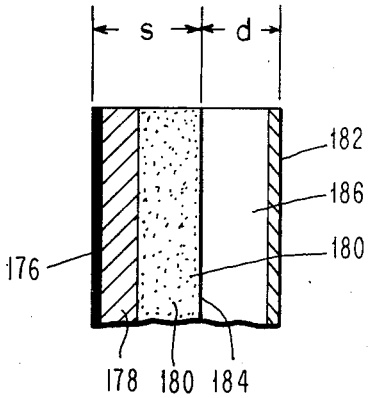

FIG. 3.1
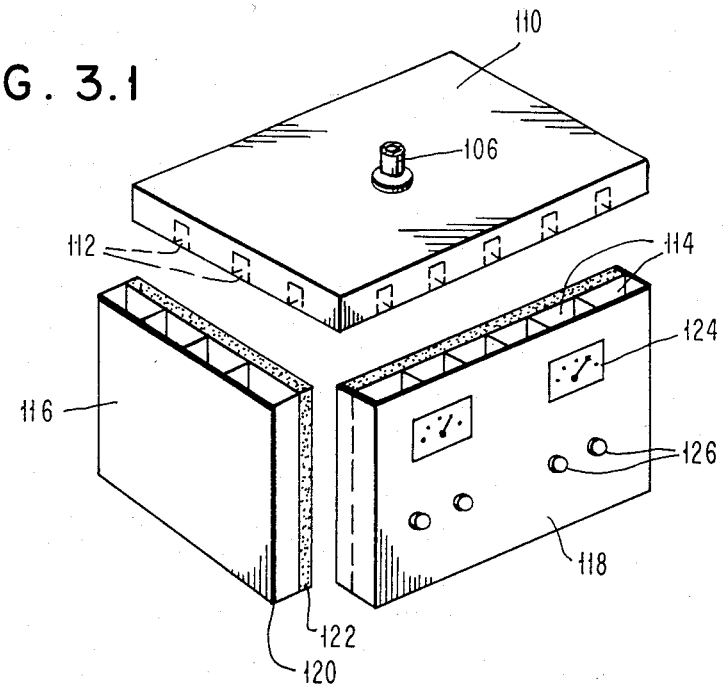
FIG. 3.2
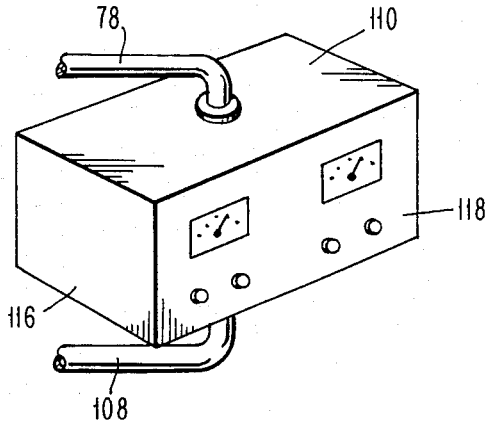
FIG. 5
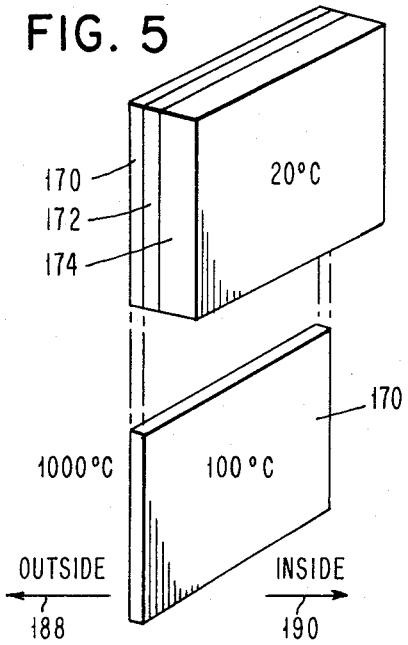

FIREPROOF CABINET SYSTEM FOR ELECTRONIC EQUIPMENT

FIELD OF THE INVENTION

The present invention relates to fire protection systems, and more particularly to fire protection systems with enhanced survivability of electronic equipment in fire and fire fighting situations.

BACKGROUND ART

There has been a longstanding need for adequate fire protection for essential electronic equipment to ensure its continuous operation and survivability under fire conditions. One approach has been to employ Halon gas as the sole fire fighting system for rooms filled with electronic equipment, particularly in those applications where it is necessary to avoid equipment damage by water or other types of fire estinguishing agents. However, reliance on a single fire fighting system could reduce the fire control capability and decrease the equipment survivability as compared to a facility equipped with multiple fire fighting systems. Also, Halon will only be effective when proper Halon volume concentration is maintained in the room. If the doors or windows of a room cannot be properly closed, or the ventilation to the room is not stopped, Halon's fire extinguishing ability will be diminished or totally ineffective. Other well known forms of fire fighting systems include equipment for directing gases, liquids, water or other fire extinguishing chemicals onto the fire. One example of such fire fighting systems is disclosed by Terry in U.S. Pat. No. 3,403,733 wherein a carbon dioxide fire extinguisher is used to extinguish a fire occuring within an electronic cabinet. The system disclosed by Terry is designed to extinguish fires occuring within a cabinet and, therefore, cannot protect the said equipment from an external fire originated in the room.

Several passive types of methods have been employed for the purpose of protecting electronic equipment during a fire and/or in fire fighting situations. For example, U.S. Pat. No. 4,135,055 to Beckers et al discloses a fireproofing casing having non-combustible, fire-resistant wall panels and means for closing the casing off so that fire gases cannot reach the protected electrical conductors contained therein. Similarly, U.S. Patent No. 4,413,683 to Hune discloses a fireproof enclosure made of flame proof refractory material that substantially encloses a valve actuator unit and prevents a flame path into the enclosure. The U.S. Pat. No. 3,119,452 to Sammis discloses a cooling device for a flight recorder wherein a coolant medium is contained with the recorder in an insulated housing and the coolant vaporizes under a predetermined temperature so as to absorb surrounding heat to maintain the recorder at a desired temperature. The internal cooling technique and the fire insulation method is designed to maintain small equipment, such as the flight recorder, intact during fire conditions. However, such cooling and insulating techniques are not practical, and sometimes are not possible due to space problems where a large array of control equipment must be protected from fire situations. Basically, they are not designed for the electronic equipment requirements, such as space problems and equipment survivability. Thus, the passive forms of fire protection for equipment are limited in space and their application, the extent and duration of the fire during which time the protection means must counter the effects of fire and heat, and their dependence upon the active fire extinguishing means being effective to bring about stoppage of the heat and fire condition in a short period of time.

In view of the above, it is an object of the present invention to maintain electronic equipment continuously functioning during an external fire and/or in a fire fighting situation. It is another object of the present invention to protect electronic equipment from fire damage and maintain its operation during fire situations occurruing over an extended length of time. It is another object to provide a fire resistant and spray proof cabinet system for electronic equipment of various sizes, without creating space problems due to the fire protection system. It is a further object to provide a fireproof cabinet system which is advantageous from the standpoint of equipment space and facility operation.

SUMMARY OF THE INVENTION

These and other objects are achieved by the present invention which provides a fireproof cabinet system for electronic equipment including wall shield with an outer metal layer that acts as a radiation shield, an inner support layer having a low thermal conductivity and a high melting point for protecting the equipment, and an insulation layer. The fireproof shield may contain transparent panels made of fire resistant material and located on the front of the shield to permit meter readings. The fire proof shield also includes openings in its lower areas for accommodating both intake and exhaust air ducts used for cooling and heat exchange system during both normal equipment operation and during an external fire. One or more water supply nozzles are mounted on top of the fireproof cabinet system for providing a continuous stream or mist of cooling water on the cabinet shield for minimizing fire damage of the shield and also providing a temperature barrier for the electronic equipment. A forced air cooling system provides cool air from an independent supply located outside of the equipment room via the coolant air intake duct into the equipment enclosure/cabinet where such coolant air enters the bottom of the enclosure/cabinet to provide the required equipment cooling. The coolant air is ducted along the top and side walls of the cabinet in a sheath formed between the outer cabinet wall and the interior so that the coolant air in combination with the cooling water mist act to cool both the equipment and to remove heat caused by the external fire. By providing an independent coolant air supply from outside the fire area and directly in through ducts in the cabinet, combined with the coolant mist being applied to the external equipment sheath, the operational condition of the equipment is maintained during the course of the external fire. A cooling fan is located at the top of the cabinet interior for forcing the coolant air through the duct formed between the inner cabinet wall and the outer wall sheath thereby cooling the electronic components prior to being exhausted outside of the cabinet.

According to another embodiment, the coolant water is provided directly into the sheath in cooling water ducts formed in the equipment ceiling and along the wall surfaces by forming a double-wall cooling channel through which the water flows and carries away and absorbs the heat into the equipment wall.

According to another embodiment, several separate equipment can be provided with exterior water mist, the exterior coolant air supply to each equipment interior, and the equipment sheath from a central control for each of the individual equipments.

In this fashion, the coolant water mist minimizes fire damage to the shield and serves as a temperature barrier for the electronic equipment while the separately ducted air cools both the equipment and removes the heat input caused by the external fire. This serves to maintain the electronic equipment continuously functioning during the fire and fire fighting operation.

BRIEF DESCRIPTION OF THE DRAWINGS

FIG. 2.1 is partial schematic cutaway view of a fireproof cabinet system, also shown in perspective view in FIG. 2.2, having open cycle water cooling arrangement (FIGS. 2.1 and 2.2 are jointly referred to herein as FIG. 2);

FIG. 3.1 is a partial schematic cutaway view of a fireproof cabinet system, also shown in perspective view in FIG. 3.2, having a closed cycle water cooling arrangement (FIGS. 3.1 and 3.2 are jointly referred to herein as FIG. 3);

FIG. 5 shows the wall construction of a shield wall according to one embodiment of the invention; and FIG. 6 shows a wall shield construction according to another embodiment of the invention.

DESCRIPTION OF THE PREFERRED EMBODIMENTS

Figure 1:
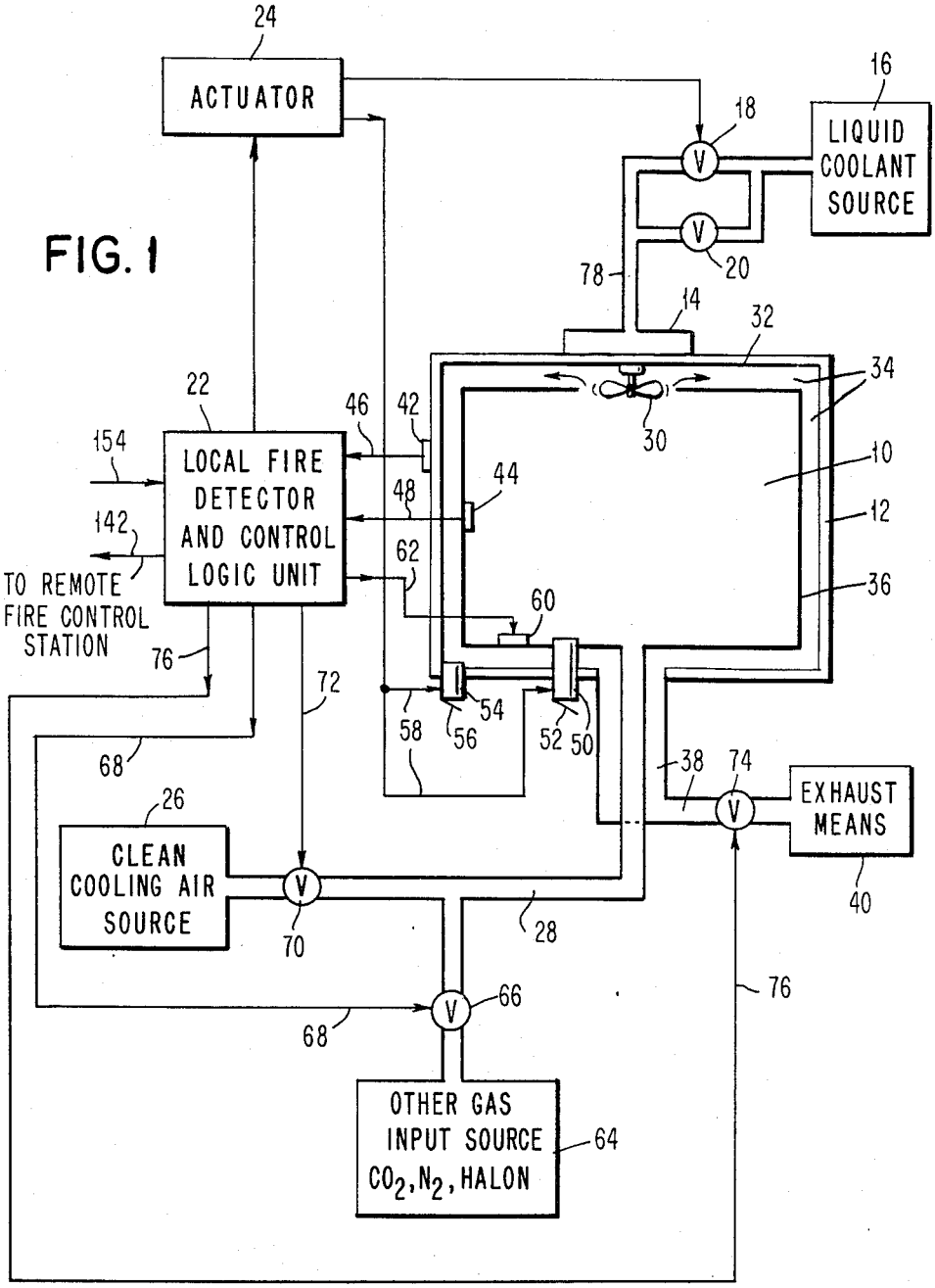
FIG. 1 is a combined functional system block diagram and cross-section view of the fireproof cabinet system of the present invention.

Referring to FIG. 1, there is shown a system diagram and schematic of the fireproof cabinet system illustrative of the present invention. The system includes a space 10 for electronic equipment, not shown, that is enclosed by a fireproof wall, hereinafter "shield" 12 positioned about equipment area 10 and designed to be spray-proof in that water and fluids cannot enter the equipment 10 from outside the shield 12. The fireproof shield 12 is cooled by an external water or other liquid coolant nozzle head 14 that is supplied from a liquid coolant source 16 via electrically activated control valve 18 or manual control valve 20 for completely wetting the shield 12 during the occurrence of high temperature conditions, such as created during an external fire and indicated by a fire detector and control logic unit 22 which causes an actuator 24 to operate the water valve 18. Further details of the operating parameters and other forms of water treatment means for the shield 12 will be described below. An active internal cooling system is provided by a remote cool air source 26 located outside of the room and environment in which the cabinet system is located and provides the cool air supply via an intake duct 28 leading into the equipment area 10 near the bottom center portion. The cool air provided from intake duct 28 is caused to flow through the equipment area 10 and up into the top area of the cabinet system where the cool air is caused by a centrally located cooling fan 30 to direct the air along the ceiling portion 32 of shield 12 and through internal air ducts 34 formed between an internal duct wall 36 and the shield 12. The duct wall 36 is spaced apart from and parallel to both the ceiling and side walls of shield 12 to cause the coolant air to contact essentially the entire internal surface of the shield wall 12. The coolant air from source 26 which cools the equipment area 10 as well as removing the heat from the fireproof shield 12 as caused by an exterior fire condition. The air passes from the ducts 34 formed by internal duct walls 36 and the shield 12 and exits through a central exhaust duct 38 which carries the hot air away from the cabinet system to exhaust means 40 at a desired location. Exhaust means 40 may include a fan.

Temperature sensors comprising an external sensor 42 and an internal sensor 44 are respectively located outside of wall shield 12 and on the internal duct wall 36 providing temperature inputs on lines 46 and 48 to the fire detector and control logic unit 22 for the exterior and the interior of the cabinet system, respectively. When the temperature has been detected by sensors 42 and 44 to be at predetermined temperatures indicating fire conditions to be described below, the detector and control logic unit 22 causes the appropriate activation of valves associated with the liquid coolant source and the coolant air supply, to be described in detail below.

Air from the room that the cabinet system is located can be provided into such cabinet system by one or more intake ports 50 located at the bottom of the system. Intake port 50 includes a closure means 52 which can be operated by an electrical signal on line 58 from actuator 24. Also, an exhaust port 54 is in communication with the air duct 34 and includes a closure means 56 for exhausting the air from duct 34 into the surrounding room. Closure means 56 is operated by actuator 24 via line 58.

In case of internal fires within the cabinet system, a source 60 of Halon is provided in the equipment space 10 and activated by a signal on line 62 from the fire detector and control logic unit 22 while the cabinet system is properly isolated for the Halon gas to reach the required volume concentration. Other means to treat the internal fire include gas inputs to the system which can be provided by gas source 64 supplying fire extinguishing gases such as $CO_2$, $N_2$ or Halon, via valve 66 and intake duct 28 to the equipment space 10. The control logic unit 22 provides a signal on line 68 to operate the valve 66. Similarly, control logic unit 22 operates a cooling air valve 70 in intake duct 28 for cooling air source 26 via line 72, and operates an exhaust valve 74 in exhaust duct 38 via line 76.

The water is provided from coolant source 16 via valve 18 and water line 78 to the nozzle head 14 mounted on the top of the fireproof shield 12 where the water is dispersed along the top shield 12 into channels or other guide means to insure that the water goes along the top surface and all four outer wall surfaces of shield 12. Actuator 24 either opens or closes the water valve 18 for supplying the nozzle head 14.

FIG. 2 shows the fireproof system of the present invention designed for open-cycle cooling wherein water provided to water supply line 78 will exit through nozzle head 14 and flow to the side walls of shield 12 and along exterior surfaces of the equipment enclosure where it absorbs the heat from the fire and maintains the temperature of the shield 12 below 100° C. In the open cycle water cooling system, the output water can be evaporated on the external surface of shield 12 whereas, by contrast, as shown in FIG. 3, in the closed cycle water cooling system, the water is entered into cooling channels in the equipment and carried away through an outlet type as will be described below. In the open cycle system, shown by the schematic cutaway view in FIG.

2, the spray head frame 80 for the shield 12 includes cooling water channels 82 for insuring that the water wets all exterior surfaces of the shield 12 as it flows from nozzle head 14 into channels 82 and off the top surface onto each of the side wall shield surfaces indicated by 84 and 86. The shield includes an outer metal radiation layer 88 that acts as a radiation shield and avoids hot spots by virtue of its high thermal conductivity. A protective and heat reflective outer coating 90 covers the metal layer 88. A support layer 92 intimately faces the metal layer 88 and is made of a low thermal conductivity material with high mechanical strength, such as a lightweight fiberglass epoxy or a plastic. Support layer 92 also has a high melting point of at least 100 degrees centigrade. Also, an insulation layer 94 comprising a high quality insulation such as a styrofoam or polypropylene may, if desired, be provided for insulating the equipment. It is noted that while an interior ducting 34 and duct wall 36, shown in FIG. 1, is provided along each of the walls of shield 12, such ducting for the coolant air is not shown in FIG. 2.

Referring again to FIG. 2, heat resistant, water tight and transparent windows 96 are provided for reading various instrument meters. Also, water tight control knobs buttons or switches 98 are provided for the equipment which are resistant to the heat and effects of fire and permit control of the equipment. The water channels 82 of spray head frame 80 has a series of small openings 100 which produce a water spray 102 around the perimeter of such head frame 80 to control fire that is close to the cabinet system. Also, channels 82 also permit the water to flow out at 104 to wet all four exterior surfaces 84 and 86 of the shield 12.

Referring to FIG. 3, there is shown a perspective view including a schematic cutaway of the closed cycle emergency cooling arrangement wherein the emergency cooling water is caused during an external fire situation to flow from the water line 78 to an inlet port 106 where it flows internally in the walls and exits from the system through an outlet pipe 108. More specifically, the water through input port 106 flows along the top wall 110 of the shield having cooling water channels 112 that communicate with further channels 114 located in the side walls 116 and 118 of the equipment shield. The side wall cooling channels 114 are double wall channels that are sandwiched between the outer metallic radiation shield layer 120 and an insulation layer 122. In the closed cycle system shown in FIG. 3, the double wall cooling channels 114 provide a support for the overall wall shield. The bottom of each cooling water channel 114 is channeled into a common outlet, not shown, leading into the water outlet pipe 108 where the heated water is removed from the system. In the closed cycle system, the water flowing inside the double wall cooling channels 114 will carry away the heat influx caused by the external fire. The water flow rate requirements of the closed cycle water cooling system are higher than the requirements for the open cycle cooling arrangement because there is no phase change of the water and, therefore, the latent heat capability is not available. A comparison of the water flow rate requirements for the two water cooling arrangements shown in FIGS. 2 and 3 is described below.

Referring again to FIG. 3, a water cooled window 124 similar to window 96 shown in FIG. 2 is provided with the exception that such window 124 is integrated with the double wall cooling channels 114 described above. Also, water tight control knobs, buttons or switches 126 similar to knobs 98 shown in FIG. 2 are provided.

A description of the operation of the fireproof cabinet system shown in FIG. 1 will now follow. The cabinet system generally operates under three conditions;

The normal operating conditions in which there is no fire situation;

The external fire condition wherein a fire exists in the room which is external to the cabinet system; and The internal fire condition occurring within the cabinet system. In the normal operating condition in which there is no fire present, the cooling air system can operate in either one of two ways. The first operation of the cooling air system provides the electronic components within the cabinet space 10 to be cooled by the room air which is received in the cabinet system via intake port 50 and such air is released from the system through the exhaust port 54 via closure means 56 leading into the room. In this normal operating mode, the fire detector and control logic unit 22 opens the closure means 52 of intake port 50 and the closure means 56 of exhaust port 54 while also closing the cooling passage to the cooling air source 26 by closing the valve 70 via signal line 72 and closing the valve 74 connected with exhaust means 40 by a signal on line 76 to such valve 74. In the alternate cooling mode under normal operating conditions, the intake port 50 and the exhaust port 54 for connecting room air with the cabinet space 10 are closed by means of signals on line 58 from actuator 24. In this alternate mode, the equipment in cabinet space 10 is cooled by air which is provided to the intake duct 28 from the cooling air source 26 and the heated air is emitted from the system via exhaust duct 38 by means of exhaust means 40. In such cooling mode, the fire detector and control logic 22 provides signals on lines 72 and 76, respectively, for opening the valves 70 and 74 associated with the cool air source 26 and the exhaust means 40.

During an external fire condition wherein a fire situation exists in the room external to the cabinet system, the system is placed in an equipment protection mode with the intake port 50 and the exhaust port 54 closed to prevent air exchange between the room and the cabinet space 10. Also, internal cooling of the cabinet system will be provided by the cooling air source 26 and the heated air will be exhausted through the exhaust duct 38 by exhaust means 40. Of course, these operations which open and close the above mentioned ports and ducts are provided by the predetermined program set for the fire detector and control logic unit 22. In this fashion, the interior of the equipment cabinet is isolated from the external surrounding environment. Also, the external cooling water can be released by the control logic unit 22 which signals the actuator 24 to open valve 18 for passing the liquid from liquid coolant source 16 in water line 78 through the nozzle head 14 for releasing the water automatically by means of fire detector and logic control unit 22 which detects the external fire conditions by means of the external temperature sensor 42. Alternately, the liquid coolant source 16 can be released manually by turning the control valve 20 to permit water to flow through the water line 78. The water released through the coolant line 78 will continuously wet the surfaces of the shield wall 12 and maintain the wall surfaces at a desired temperature of, for example, 100 degrees centigrade or lower.

During the external fire condition, the system shown in FIG. 1 can provide a remote fire fighting operation in which inert gases such as carbon dioxide, nitrogen and Halon, can be discharged remotely into the room surrounding the cabinet system through the cabinet system itself. This is provided by closing the room intake port 50 and the exhaust duct 19 by providing electrical signals from the detector and control logic unit 22 so that no surrounding room air is permitted to enter the cabinet system while the exhaust duct 38 is closed off. At the same time, the room exhaust port 54 is open by opening a closure means 56 to permit the air or gas in the internal air duct 34 to be exhausted into the surrounding room. The clean air source 26 is blocked by a signal on line 72 which closes the valve 70 while the valve 66 is caused to be open by a signal on line 68 from the detector and control logic 22 to thereby permit the fire fighting gases from source 64 to be fed into the cabinet space 10 and exhausted through the exhaust port 54 and closure means 56 to the surrounding room. In this fashion, the fire fighting gases will be pumped into the room remotely through the cabinet system of the present invention.

In the event that there is an internal fire caused by an electronic component within the cabinet system, the internal sensor 44 detects the fire condition and signals the fire detector and control logic unit 22 to close all of the cooling ports 50 and 54 and the valve 70 connecting the cooling air source as well as the exhaust duct valve 74 leading into exhaust means 40. This action will isolate the interior of the cabinet system from the outside room environment. At this point, the Halon source 60 is activated by the signal on line 62 from the detector and control logic 22 for extinguishing the internal fire. The exhaust port 54 will be caused to release the internal gases by a signal on line 58 for opening the closure means 56 when the internal pressure in cabinet space 10 rises above a preset level during the Halon discharge.

It is noted that the internal cooling capacity of the system is designed to operate with the cooling fan 30 providing normal operation cooling when their is no fire condition. During a fire situation, the cooling fan could be provided with a higher speed operation or with additional cooling fan means which are activated under fire conditions to thereby increase the flow rate of the fan or fans provided. In the same fashion, the cooling fan 30 may be designed to operate at essentially the same speed and flow rate during both the normal, non-fire condition and the fire condition where it is determined that the air flow rate is adequate during the fire situation. It is also noted that the electrical power and signal cables can be enclosed either in the intake duct 28 or the exhaust duct 19.

Figure 4:
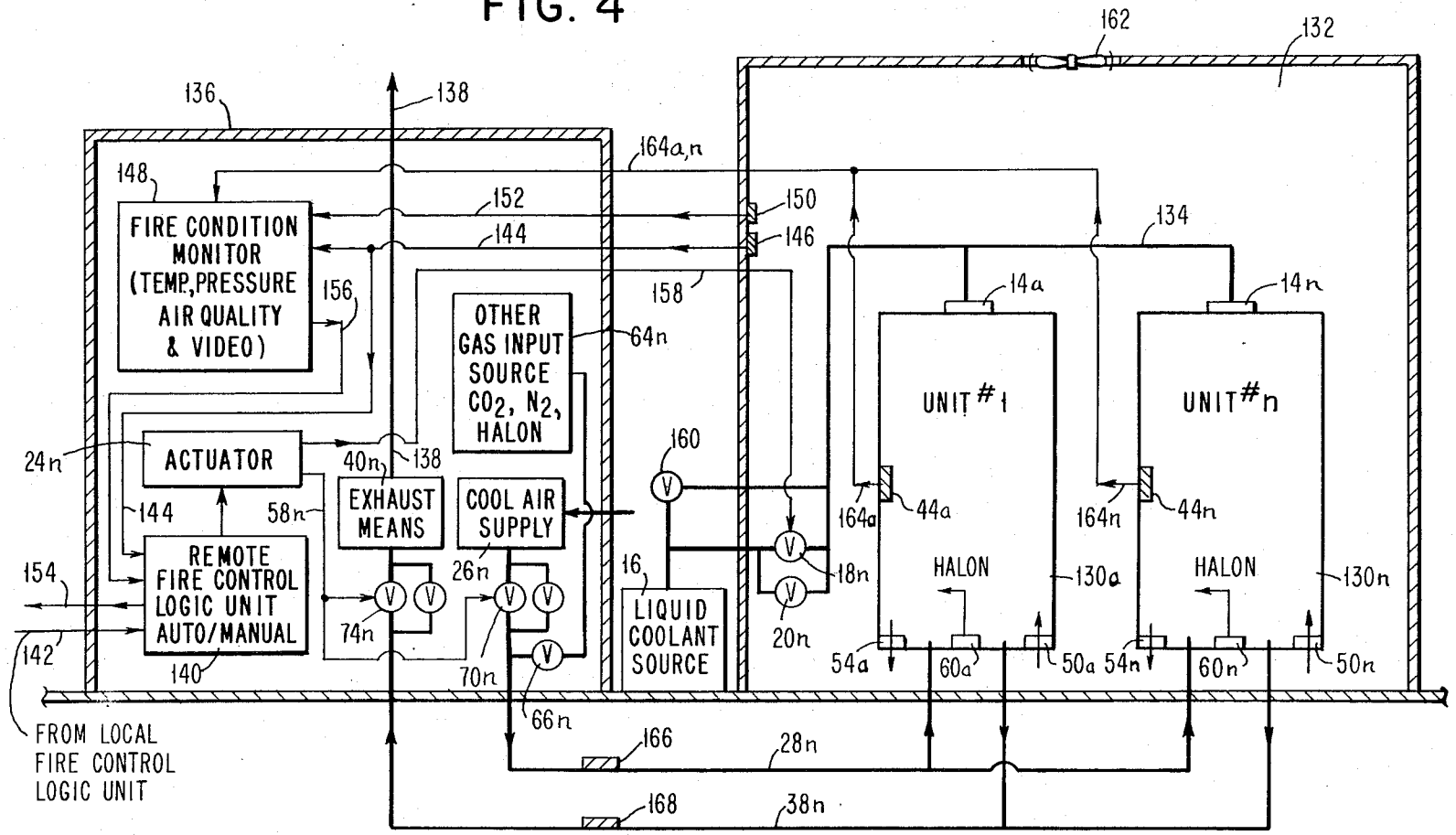
FIG. 4 is a functional diagram of a fire control and monitoring system for operating several cabinet systems in a control room facility;.

Referring to FIG. 4, there is shown a functional diagram of a fire control and monitoring system and control room facility incorporating the fireproof cabinet system of the present invention. Here, two cabinet systems 130*a* and 130*n* are shown in a control room facility 132 in accordance with the present invention with each system being connected by similar ducting and cooling means as will be described. It is noted that while only two cabinet systems 130*a* and 130*n*, indicated as units 1 and n, are shown, any desired number n of such systems can be operated from the control room facility 132. Each cabinet system 130*a*–130*n* is essentially identical to the cabinet system shown in FIG. 1 and comprises the same fireproof wall shield 12, coolant water nozzle head 14, internal air duct 34, duct walls 36, intake duct 28*n*, exhaust duct 38*n*, internal temperature sensor 44*a, n*, Halon sources 60*a, n*, room intake ports 50*a, n*, room exhaust ports 54*a, n* as well as other portions of the system not shown in FIG. 4, but otherwise shown and described with respect to FIG. 1. Also, a central control system 136 comprises a valve actuator 24*n* for operating a valve 18*n* to control the flow from liquid coolant source 16 through coolant line 134 to spray heads 14*a, n*, a cool air supply 26*n* for providing cool air via valve 70*n* and intake duct 28*n* to each cabinet system, and exhaust means 40*n* for removing the heated air via exhaust ducts 38*n*, valve 74*n*, and exhaust vent 138. A gas input source 64*n* provides fire extinguishing gases, such as carbon dioxide, nitrogen and Halon, via valve 66*n* and intake ducts 28*n*, to the electronic space in each cabinet system 130*a, n*. A remote fire control logic unit 140 is connected in the central control system 136 for receiving local control signals on line 142 from the local fire detector and control logic unit 22 shown in FIG. 1, and monitor and sensor signals on line 144 from a fire sensor 146 in the control room facility 132 and on line 156 from a fire condition monitor 148. The fire condition monitor 148 receives sensor and monitor signals from sensor devices 150 such as temperature, pressure, air quality and video monitors, via line 152 from the control room facility 132. It is noted that while the local fire detector and control logic unit 22 shown in FIG. 1 may provide local detection and control logic functions in addition to the remote fire control logic unit 140 to which it is shown connected to it via lines 142 and 154, such local detector and control logic unit 22 can have all of its functions and circuitry incorporated in the central remote fire control logic unit 140. In such case, the remote unit 140 provides all of the detection and valve activation signals for controlling the supply of liquid coolant and cool air to each of the cabinet systems 130*a–n*.

A liquid coolant source 16, essentially the same as the source 16 shown in FIG. 1 provides water on line 134 to each of water nozzle heads 14*an*, similar to the nozzle head 14 described above with reference to FIG. 1 such that the water continuously covers the outside shield of each of the fireproof cabinet systems during a fire situation. The coolant line 134 is opened or closed by a control signal on line 158 from actuator 24*n* to valve 18*n* and, also, by local manual control valve 20*n* and remote manual control valve 160 which can bypass the valves 18*n* and 28*n*.

Exhaust ports 54*a, n*, vent the air out of each fireproof cabinet system while intake ports 50*a, n* provide control means for ducting air into each system. Ports 50*a, n* and ports 54*a, n* are operated by closure means from signals from the remote fire control logic unit 140 in the same manner as described for the closure means 52 and 56 shown in FIG. 1. As shown, each of these ports 50*a, n* and 54*a, n* are vented to the control room facility 132 and are maintained in their open position for normal venting of the equipment into the control room facility 132 during normal operation when there is no high temperature caused by a fire. A room exhaust fan 160 provides an exhaust for the control facility 132.

Referring again to FIG. 4, there will be described the operation of the remote fire control system when a fire condition exists in the room indicated by the control room facility 132. Here, when the fire sensor 146 or other sensor devices 150 detect a fire condition, a signal is provided on lines 144 and 152 to the fire condition monitor 148 which in turn indicates on lines 144 and 156 to the remote fire control logic unit 140 the existence of the fire condition for in turn effecting the fire protection procedure. Such fire protection procedure includes releasing the cooling water via actuator 24*n* and valve 18*n* to permit the liquid coolant source 16 to provide a flow to the spray heads 14*a, n* for wetting all the exterior wall shields of the cabinet systems 130*a, n.* Also, the water spray is directed adjacent to the cabinet systems for extinguishing fire in the vicinity as described with respect to the FIG. 2. If desired, the local or remote manual control valves 20*n* and 160 can be manually operated to provide the coolant. In one automatic cooling mode, the fire control logic unit 140 will cause actuator 24*n* to close the air intake ports 50*a, n.* In this cooling mode, the cool air supply 26*n* is blocked by closing valve 70*n* while the valve 66*n* is opened by the control logic unit 140 to permit the fire fighting inert gases from gas input source 64*n* to flow through intake duct 28*n* into the control room facility 132 by passing first through the cabinet systems 130*a, n* and out through the open exhaust ports 54*a, n.* This gas will temporarily provide a cooling function for the interior of each cabinet system when used to extinguish the fire condition in the control room facility.

In the normal cooling mode the cooling air is provided by the cool air supply 26*n* and ducts 28*n* to the units and exhausted through ducts 38*n* to the exhaust means 40*n.* During this time the intake ports 50*a, n* and exhaust ports 54*a, n* are closed to isolate the cabinet systems 130*a, n* from the control room facility 132.

The remote fire control logic unit 140 includes conventional microprocessor logic gating circuits which are programmed to receive the detected fire condition signals and to provide the predetermined operation of the above described valve, intake and exhaust ports, inert gas and cool air supply means to the cabinet systems, and the liquid coolant source for wetting the wall shields of such cabinet system. Therefore, different modes of supplying the cool air, the inert gases and the liquid coolant to the control room facility 132 can be provided by the programming of the remote fire control logic unit 140. Since the electrical circuitry and microprocessor for providing these standard type of logic functions is well known in the art, no detailed description or drawings of such circuitry is believed to be necessary.

In the normal operation of the fire control system when a fire condition is detected outside of the cabinet systems 138*a, n,* the cabinet system operates in the manner described with respect to the system shown in FIG. 1 wherein the cool air supply 26*n* is provided via valve 70*n* and ducts 28*n* into the cabinet systems 130*a, n* and the liquid coolant source 16 provides the liquid through valve 160 and lines 134 to the spray heads 14*a*, 14*n* so that the combined effect of the coolant fluid wetting the wall shield and the cool air being supplied through the internal ducts, shown in FIG. 1 by numeral 34, will maintain the cabinet systems at the operating temperature. Also, the heated air is exhausted via exhaust ducts 38*n* by exhaust means 40*n* and vent 138.

The remote fire control system shown in FIG. 4 also provides fire fighting means when a fire condition occurs inside any one of the cabinet systems 130*a, n.* Here, one of the fire sensors 44*a, n* detects the fire condition in the cabinet and signals the fire condition monitor 148 via lines 164*a, n* to cause the intake and exhaust ports 50*a* or 50*n* of the particular cabinet system having the fire condition to be closed. The control logic unit 140 then activates the Halon source 60*a, n* of the particular cabinet system, such as 130*n* to extinguish the fire. In this operation, the normal operation of the other cabinet systems not effected by an internal fire condition will proceed as normal. Also, it is noted that several valves, not shown, for the fighting of a fire condition within any particular cabinet system can be designed to operate both manually and automatically for each cabinet system, as desired.

In another situation where a fire condition exists inside a cable conduit such as the intake ducts 28*n* or the exhaust ducts 38*n*, the sensors 166 and 168 are provided within the ducts for signaling to the fire condition monitor 148 to close the valve 70*n* to block off the cool air supply 26*n*, close the intake ports 50*a, n* and exhaust ports 54*a, n,* and open the valve 66*n* to cause inert gas from source 64*n* to circulate through the duct system via each equipment and also provide the temporary cooling for such equipment.

After a fire condition is effectively brought under control and eliminated, the room air quality can be restored by operating the exhaust fan 162 to expell the smoke and toxic gases from the control room facility 132 while fresh air can be pumped into the control room facility through the cool air supply 26*n*, intake duct 18 and the exhaust ports 54*a, n.*

The fireproof cabinet system of the present invention is designed with the purpose of insuring that the electronic equipment survives fires and maintains a continuous working condition, without interruption or damage during the fire fighting process. The objects are achieved by a combination of inter-related system features, these bring the fire and spray-proofing of the enclosure walls; the continuous wetting of the exterior wall shield surfaces; and the continuous supply of an external cool air, from a source outside of the control room, to the equipment interior with special cool air circulation along the interior shield surfaces such that the combined effects of the water on the exterior shield surfaces and the coolant air on the interior shield surfaces serves to maintain the equipment operating at desired temperatures and protects the equipment from the effects of heat and fire.

The preferred relationships between the shield, wall insulation, its thickness, and water and air cooling requirements are now described for providing the desired system operation and performance. A preliminary calculation to estimate the approximate cooling requirement for an arbitrary equipment enclosure size of 50 cm×50 cm×50 cm is provided as an illustration. The enclosure wall construction can be made as shown in FIG. 5 wherein an outer shield coating 170 having a thickness of about 1.0 mm is applied onto a steel wall 172 having a similar thickness of about 1.0 mm. The Teflon coating 170 has a K=0.003 W/CM-°C., whereas the K coefficient of the steel wall 172 is 0.1 W/CM-°C. An asbestos insulating layer 174 having a coefficient K of 0.0008 W/CM-°C. and a thickness of about 10 mm is secured adjacent to the steel wall 172. While the materials and their thickness have been selected for the purpose of heat transfer calculation only for an equipment enclosure of 50 cm×50 cm×50 cm, it should be apparent that different sized enclosures can be made by applying scaling factors, and that other materials can be chosen to achieve the desired design result.

The enclosure wall constructions and materials can, for example, comprise a protective and heat reflective coating the outer metallic shield layer 176 shown and described in reference to FIGS. 2 and 6, a low thermal conductivity support layer 178 and an insulation layer 180. The wall shield construction shown in FIG. 6 includes an inner duct wall 182 spaced apart from the inside surface 184 of the insulation layer 180 to form the duct air space 186 through which the coolant air flows. Typical thickness for example, are a wall thickness "s" of $\frac{1}{4}$ to $\frac{1}{2}$ inch and a duct width "d" of $\frac{1}{8}$ to $\frac{1}{2}$ inch.

It is assumed that the room temperature under fire conditions is 1000° C. outside the enclosure as indicated in FIG. 5 by arrow 188, with the exterior surface 170 of the enclosure being maintained at 100° C. by the flowing water. The initial temperature of the enclosure interior 190 is at 20° C. During the fire, the interior is cooled by circulating air coming from the ducts. The incoming duct air is assumed, for purpose of this example, to be 20° C. and the exhaust air 50° C. The calculation results shown in Table I employ the known characteristics, namely the specific heat of water of 1.0 Cal./gm-°C.; the specific heat of air of 0.25 Cal/gm-°C.; an air density of 1.3 gm/Liter and a water density of 1.0 gm/C.C. In Table I, there are set forth the heat removal effects of the cooling water flow for maintaining the shield exterior surface at 100° C., and the water flow requirements for both the open cycle (FIG. 2) and closed cycle (FIG. 3) water cooling systems. The calculations were made for a 1000° C. room temperature and its effect on the 50 cm×50 cm×50 cm enclosure.

TABLE I

| EXTERNAL COOLING WATER FLOW | OPEN CYCLE | CLOSED CYCLE |
|---|---|---|
| Steady State Heat Input | 24.8 W/CM$^2$ | 24.8 W/CM$^2$ |
| Total Heat Input (15,000 CM$^2$ area) | 372,000 Watts | 372,000 Watts |
| Water Flow Rate Requirement Input water at 15° C., output water at 100° C. | 7.8 Liter/Min. (2.1 Gallon/Min.) | 62.5 Liter/Min. (16.5 Gallon/Min.) |

The wall thickness of the enclosure will be in a range from 0.5 cm to 2.0 cm including the coating, the double-wall cooling channel, and the wall insulation. The required cooling water rate is about two gallons per minute for the open-cycle design and sixteen gallons per minute for the closed-cycle design.

In Table II, there is set forth the coolant air flow requirements for cooling the above described exampled enclosure during an external fire wherein the air is exhausted from the enclosure at 50° C.

TABLE II

| INTERNAL COOLING AIR FLOW | |
|---|---|
| Steady State Heat Input | 0.067 W/CM$^2$ |
| Total Heat Input (15,000 CM$^2$ Area) | 1000 Watt |
| Air Mass Flow Rate Requirement (Duct Air Temp. 20° C. input 50° C. output) | 24 Liters/Sec. (51 SCFM) |

As shown in Table II, the requirement cooling air rate is about 50 SCFM. This can be supplied by a commercially available fan. While it is apparently easier to apply the fireproof cabinet system of the present invention to new equipment and installations, this type of equipment fire protection system can also be employed on existing equipment by replacing the existing enclosures with the fireproof cabinet and install duct in trenches or under the false floor.

In accordance with the features of the present invention, an equipment fire protection enclosure can be designed to meet the specifications of various applications, with the temperature profiles in the enclosures wall and interior being measured as a function of (a) the variation of wall design composition, materials and its thickness, (b) the rate of cooling water, (c) the rate of cooling air flow, and (d) combinations of the above. With the system of the present invention there is thus provided a fireproof cabinet system which maintains essential equipment functioning at a safe operating temperature for an extended period of time during an exterior fire in the room.

While the invention has been described above with respect to its preferred embodiments, it should be understood that other forms and embodiments may be made without departing from the spirit and scope of the present invention.

What is claimed is:

1. A system for protecting electronic equipment and maintaining its continuous function during an external fire in a room area surrounding said equipment, comprising:

a fire resistant and waterproof wall shield enclosure for enclosing said equipment, said wall shield enclosure including an outer metal layer having a high thermal conductivity and providing a radiation shield, an adjacent support layer having a low thermal conductivity and high mechanical strength, and an inner wall duct means extending along the support layer on the inside of said wall shield means for passage of a gas coolant adjacent said wall shield enclosure for cooling said wall shield;

water supply means for continuously providing coolant water on substantially the entire outside surfaces of said outer metal layer of said wall shield enclosure to remove heat therefrom and preventing fire damage to said wall shield enclosure;

forced gas cooling means for providing coolant gas from outside said wall shield enclosure into said inner wall duct means of said wall shield enclosure for cooling an interior thereof and also removing heat received from said outer metal layer, said forced gas cooling means including a coolant gas supply, an intake duct means leading from said coolant gas supply into the interior of said wall shield enclosure, and exhaust duct means for removing heated air from said inner wall duct means to the outside of said wall shield enclosure; and control means responsive to the detection of a fire condition in said room area for activating said water supply means;

whereby said coolant gas in combination with said continuous coolant water on said outer metal layer act to decrease the heating effects of fire on said wall shield enclosure and remove heat from the interior thereof to maintain said electronic equipment in operation at a desired temperature and air quality.

2. A system as recited in claim 1, wherein said inner wall duct means comprises a wall means providing a duct wall which is spaced apart and adjacent to said support layer of said wall shield enclosure and extending substantially over said wall shield enclosure so that said gas coolant will cool substantially the entire surface area of said wall shield enclosure.

3. A system as recited in claim 1, wherein said wall shield enclosure comprises at least side walls extending completely around the equipment to be protected, and a top wall connected to said side walls.

4. A system as recited in claim 1, wherein said water supply means includes nozzle head means located on the exterior of said wall shield enclosure at the top portion thereof for providing said coolant water to the top wall portion of said wall shield enclosure.

5. A system as recited in claim 4, wherein said water supply means further comprises a water channel distribution head in a top wall of said wall shield enclosure, said water distribution head including channels for distributing the water from said nozzle head onto all exterior surfaces of said wall shield enclosure for wetting the same.

6. A system as recited in claim 4, wherein said water supply means includes water channel means connected in communication with said water nozzle head and extending through a top wall of said wall shield enclosure, said wall shield enclosure including water cooling channels extending throughout the side walls thereof and in fluid communication with said water cooling channels in the top wall of said wall shield enclosure so that the entire wall shield enclosure is cooled internally by said coolant water, and further comprising water outlet means connected at the bottom of said wall shield enclosure for receiving the water passing through said water cooling channels in said side walls of said wall shield enclosure, whereby a closed cycle water cooling of said system is provided.

7. A system as recited in claim 5, wherein said nozzle head includes water distribution means for directing said coolant water onto the outside surfaces of said wall shield enclosure, and water spray head means located at the top of said wall shield enclosure for directing said coolant water away from said wall shield enclosure for controlling any fire located close to said wall shield enclosure.

8. A system as recited in claim 1, wherein said control means includes means for sensing a fire condition located outside of said wall shield enclosure, and control means responsive to said detected fire condition of said sensing means for activating said water supply means to provide coolant water to said wall shield enclosure.

9. A system as recited in claim 8, wherein said control means is connected to said forced gas cooling means for controlling the supply of coolant gas to said wall shield enclosure.

10. A system as recited in claim 1, further comprising fire sensing means located inside said wall shield enclosure for sensing fire conditions therein, said internal fire sensing means providing an output to said control means.

11. A system as recited in claim 1, wherein said forced gas cooling means includes an air source of a clean and cool supply of air which constitutes said coolant gas.

12. A system as recited in claim 11, wherein said forced gas cooling means further comprises a source of inert gas, and said control means includes means for activating said inert gas source for applying said inert gas into said wall shield enclosure.

13. A system as recited in claim 1, further comprising an intake port for communicating the interior of said wall shield enclosure with the exterior thereof, and an exhaust port in communication with said exhaust duct means for exhausting said gas through said exhaust duct to the exterior of said wall shield enclosure.

14. A system as recited in claim 13, wherein said control means includes means for opening and closing said intake port and said exhaust port in response to sensed fire conditions.

15. A system as recited in claim 1, wherein said exhaust duct means includes means for exhausting the heated gas through said inner wall duct to a location outside of said room area.

16. A system as recited in claim 15, wherein said control means further comprises means for selectively activating said exhaust means.

17. A cabinet system for enclosing and protecting electronic equipment and maintaining its continuous function during an external fire in a room area surrounding said equipment, comprising:

a fire resistant and water proof wall shield enclosure for enclosing said equipment, said wall shield enclosure including an outer metal layer having a high thermal conductivity and providing a radiation shield, and wall support means for supporting said outer metal layer;

water supply means for continuously providing coolant water on substantially the entire outside surfaces of said outer metal layer of said wall shield enclosure to remove heat therefrom and preventing fire damage to said wall shield enclosure;

forced gas cooling means for continuously supplying a coolant gas against an interior surfaces of said wall shield enclosure for cooling the interior thereof and also removing heat received from said outer metal layer said forced gas cooling means including a coolant gas supply, an intake duct means leading from said coolant gas supply into the interior of said wall shield enclosure and exhaust duct means for removing heated air to the outside of said wall shield enclosure;

control means responsive to the detection of a fire condition in said room area for activating said water supply means and said forced gas cooling means;

whereby said coolant gas in combination with said continuous coolant water applied on said outer metal layer act to decrease the heating effects of fire on said wall shield enclosure and remove heat from the interior thereof to maintain said electronic equipment in operation at a desired temperature and air quality.

* * * * *